United States Patent [19]

Ishikawa et al.

[11] Patent Number: 4,905,283

[45] Date of Patent: Feb. 27, 1990

[54] SURROUND DECODER

[75] Inventors: Tsutomu Ishikawa; Ryuichi Ogawa; Masaya Tanno; Fumio Tosaka, all of Gunma, Japan

[73] Assignee: Sanyo Electric Co., Ltd., Moriguchi, Japan

[21] Appl. No.: 390,056

[22] Filed: Aug. 7, 1989

[30] Foreign Application Priority Data

Aug. 12, 1988 [JP] Japan ..... 63-107176[U]

[51] Int. Cl.[4] ..... H04S 3/00

[52] U.S. Cl. ..... 381/22

[58] Field of Search ..... 381/5, 18, 19, 20, 21, 381/22

[56] References Cited

U.S. PATENT DOCUMENTS 3,934,086 1/1976 Takahashi ..... 381/22
3,959,590 5/1976 Scheiber ..... 381/22
4,574,391 3/1986 Morishima ..... 381/24
4,589,129 5/1986 Blackmer et al. ..... 381/18
4,807,217 2/1989 Ide ..... 381/1

OTHER PUBLICATIONS

"Nikkei Electronics", issued Jun. 27, 1988; pp. 88–89.

*Primary Examiner*—Forester W. Isen
*Attorney, Agent, or Firm*—Armstrong, Nikaido, Marmelstein, Kubovcik & Murray

[57] ABSTRACT

A surround-decoder comprises terminals to which left and right stereo input signals are applied, a decoder for processing the left and the right stereo input signals to provide left and right stereo output signals, a center output signal and a surround output signal, circuits for detecting the left and the right stereo input signals to be monaural signals, and a switch responsive to an output signal of the detecting circuit for cutting off an output of a surround signal from the decoder.

5 Claims, 2 Drawing Sheets

SURROUND DECODER

BACKGROUND OF THE INVENTION

1. Field of the Invention

The present invention relates to a surround decoder capable of generating left and right stereo output signals, a center output signal and a surround output signal, and more specifically, to a surround decoder in which generation of unnecessary surround output signals is prevented in receiving a monaural signal.

2. DESCRIPTION OF THE BACKGROUND

An article regarding to Dolby Pro Logic Surround System proposed by Dolby Laboratories Licensing Corp. of the United States appears on pp. 88–89 in "NIKKEI Electronics" issued on June 27, 1988. As shown in FIG. 2, the system is comprised of left and right input terminals 1 and 2 to which left and right stereo signals $L_T$ and $R_T$ applied, a first adder circuit 3 for adding the left and right stereo signals $L_T$ and $R_T$ to generate a sum signal C' ($=L_T+R_T$), a subtractor circuit 4 for subtracting the right stereo signal $R_T$ from the left stereo signal $L_T$ to generate a difference signal S' ($=L_T-R_T$), first and second detection circuits 5 and 6 for respectively detecting levels of the left and right stereo signals $L_T$ and $R_T$, third and fourth detection circuits 7 and 8 for respectively detecting levels of the sum and difference signals C' and S', a first level ratio detection circuit 9 for detecting level ratio of output signals of the first and second detection circuit 5 and 6, a second level ratio detection circuit 10 for detecting level ratio of output signals of the third and fourth detection circuits 7 and 8, a VCA (Voltage Controlled Amplifier) 11 including a plurality of gain controlled amplifier circuits (not shown) each controlling the level of the left or right stereo signal $L_T$ or $R_T$ in response to any one of output signals of the first and second level ratio detection circuits 9 and 10, a second adder circuit 12 for selectively adding the left and right stereo signals and output signals of the VCA 11 to generate left and right stereo output signals L and R, a center output signal C and a surround output signal S, a center mode control circuit 13 for switching between the left and right stereo output signals L and R and the center output signal C in response to a mode, and a passive decoder 14 for performing signal processing such as delay and noise reduction to the surround output signal S. Therefore, a structure such as shown in FIG. 2 enables a signal processing of enhancement of direction to clarify surround localization of sound, so that acoustics having presence can be provided to listeners. Particularly, the system is effective when applied to an audio signal processing of a large-sized television, so that it can produce the same effect on audience as that is obtained in seeing a picture at a theater.

However, if a monaural signal is received by means of the surround-decoder employed in the system, unnecessary signals are generated from a surround output terminal from which basically no output signal is generated. More specifically, noise generated in a transmission system or crosstalk component of other channel signals are generated at the surround output terminal as an output signal, thereby causing listeners to feel incompatible or uncomfortable.

SUMMARY OF THE INVENTION

An object of the present invention is to provide a surround decoder in which generation of unnecessary surround output signals is prevented in receiving a monaural signal.

The surround decoder according to the present invention, in short, comprises a detection circuit for detecting an input signal to be a monaural signal, and a cutting off circuit for cutting off a surround signal path in response to an output signal of the detection circuit.

According to the present invention, a surround signal path can be cut off when the input signal is detected to be a monaural signal, so that generation of unnecessary signals from a surround output terminal can be prevented, thereby not causing listeners to feel incompatible or uncomfortable.

The foregoing and other objects, features, aspects and advantages of the present invention will become more apparent from the following detailed description of the present invention when taken in conjunction with the accompanying drawings.

BRIEF DESCRIPTION OF THE PREFERRED EMBODIMENTS

Figure 1:
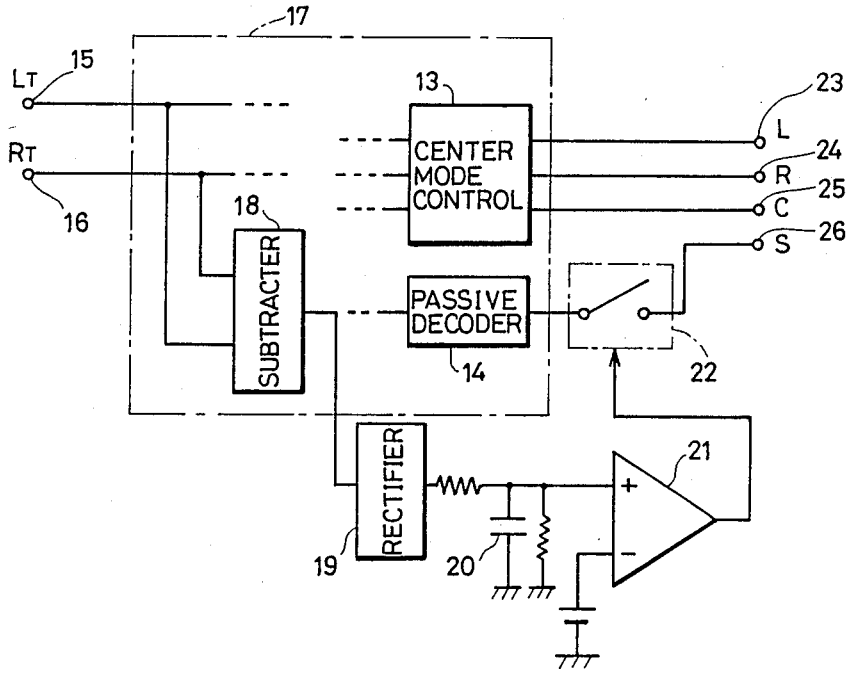
FIG. 1 is a circuit diagram showing one embodiment of the present invention.
Figure 2:
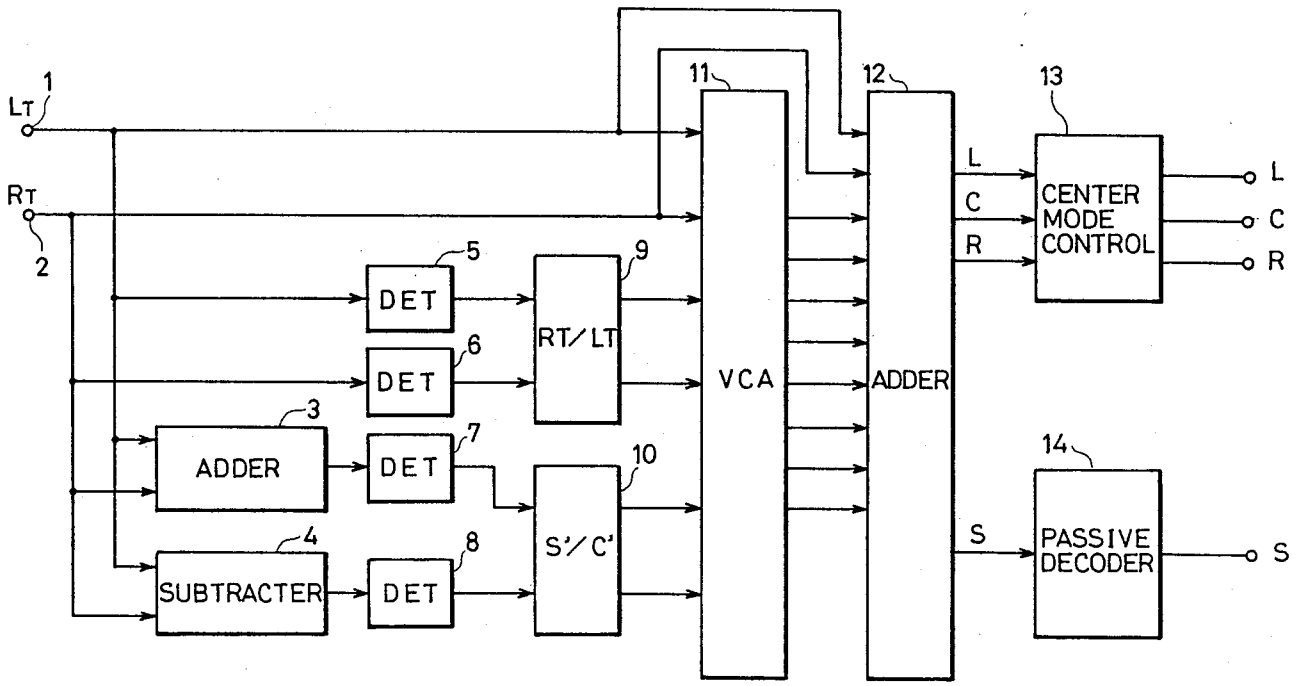
FIG. 2 PRIOR ART
FIG. 2 is a schematic block diagram showing a conventional surround-decoder system.

FIG. 1 is a circuit diagram showing one embodiment of the present invention, wherein 15 denotes a left input terminal to which a left stereo input signal $L_T$ is applied, 16 denotes a right input terminal to which a right stereo input signal $R_T$ is applied, 17 denotes a surround-decoder comprising, as well as FIG. 2, a center mode control circuit 13 and a passive decoder 14, 18 denotes a subtracter circuit which can be also used as a subtracter circuit of the surround-decoder 17, and for subtracting signals applied to the left and the right input terminals 15 and 16, 19 denotes a rectifier circuit for rectifying an output signal of the subtracter circuit 18, 20 denotes a capacitor for smoothing a signal rectified in the rectifier circuit 19, 21 denotes a comparing circuit for comparing a terminal voltage of the capacitor 20 with a reference voltage, and 22 denotes a switch inserted into an output end of the passive decoder 14 and controlled by an output signal of the comparing circuit 21.

Now, the operation will be described. When stereo signals $L_T$ and $R_T$ are respectively applied to the left and the right input terminals 15 and 16, respectively, the stereo signals $L_T$ and $R_T$ are processed in the surround-decoder 17, so that left and right stereo output signals L and R, a center output signal C and a surround output signal S are generated at first through fourth output terminals 23–26, respectively. Since at this time stereo signals are received, a difference signal ($L_T-R_T$) is generated at an output end of the subtracter circuit 18 to be rectified in the rectifier circuit 19, and smoothened in the capacitor 20 so as to be compared with the reference voltage in the comparing circuit 21. Therefore, an output signal is generated at an output end of the comparing circuit 21, thereby holding the switch 22 turned on.

Accordingly, when the stereo signals $L_T$ and $R_T$ are received, the surround output signal S as well as the left and the right stereo signals L and R and the center output signal C is correctly obtained so that surround listening is possible.

On the other hand, when a monaural signal is applied to the left and the right input terminals 15 and 16, the signals applied to both of input terminals 15 and 16 become equal, so that the difference signal ($L_T - R_T$) becomes zero. Therefore, even if rectified and smoothed, the terminal voltage of the capacitor 20 does not rise so that no output signal of the comparing circuit is generated. Accordingly, the switch 22 is turned off to prevent generation of the surround output signal S at the fourth output terminal 26.

Also when a monaural signal is applied to the left and the right input terminals 15 and 16, if noise or crosstalk exists, levels of signals applied to both of the input terminals 15 and 16 become different, so that a difference signal corresponding to the noise or the crosstalk component is generated from the subtracter circuit 18. Although the difference signal is smoothened in the capacitor 20 after rectified in the rectifier circuit 19, the difference signal corresponding to the noise or the crosstalk component has a short duration or its level is low, so that the terminal voltage of the capacitor 20 does not become larger than the reference voltage, whereby no output signal is generated from the comparing circuit 21. Accordingly, even when noise or crosstalk exists, the switch 22 is held turned off, so that no unnecessary output signal is generated from the fourth output terminal 26.

Also while receiving stereo, in some cases signals applied to the left and the right input terminals 15 and 16 become momentarily equal. In such a case, the switch 22 might be turned off, however, if a discharge time constant of the smoothing capacitor 20 is set comparatively large, such situation can be coped with, so that no malfunction occurs. Accordingly, smoothing capacitor 20 is designed so as to have a comparatively large charge time constant adaptable to noise or crosstalk component, and a comparatively large discharge time constant adaptable to a malfunction in stereo receiving.

Figure 3:
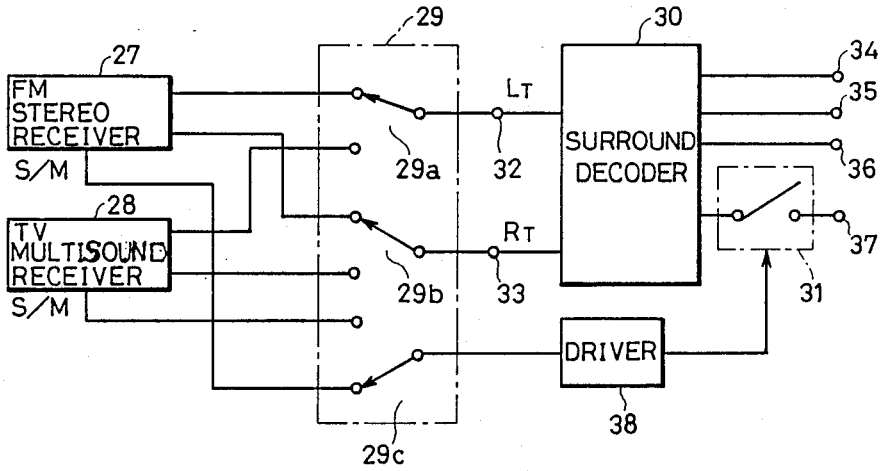
FIG. 3 is a circuit diagram showing another embodiment of the present invention.

FIG. 3 is a circuit diagram showing another embodiment of the present invention, wherein 27 denotes an FM stereo receiver being a signal source, 28 denotes a television multi-sound receiver also being a signal source, 29 denotes an input switching circuit, 30 denotes a surround decoder similar to FIGS. 1 and 2, and 31 denotes a switch for cutting off a surround signal. Now, in listening an FM stereophonic broadcasting, a state of the input switching circuit 29 is as shown in the drawing, wherein left and right stereo signals of the FM stereo receiver 27 are applied to left and right input terminals 32 and 33 of the surround-decoder 30 to be processed therein, so that left and right stereo output signals, a center output signal and a surround output signal are generated at first through fourth output terminals 34–37. Since at this time, a signal indicating stereo is generated from the FM stereo receiver 27 according to existence of a 19 KHz stereo pilot signal, if the pilot signal is received at a third switch **29*c* of the input switching circuit 29 to be applied to a driving circuit 38, the switch 31** can be turned on for surround listening.

If the FM stereo receiver 27 is in monaural broadcasting receiving, no 19 KHz stereo pilot signal exists, so that no output signal is generated from the driving circuit 38. Therefore, the switch 31 is turned off, so that no unnecessary output signal is generated from the fourth output terminal 37.

In television multi-sound broadcasting receiving, first through third switches **29*a*–29*c* of the input switching circuit 29 are switched reverse to those shown in the drawing, whereby output signals of the television multi-sound receiver 28 are applied to the left and right input terminals 32 and 33 of the surround-decoder 30, so that output signals are generated at respective output terminals 34–37. At this time, if the television multi-sound receiver 28 receives a stereo, a signal indicating the presence of a 982.5 Hz stereo identifying signal is applied to the driving circuit 38 through the third switch 29*c*, thereby turning on the switch 31, so that surround listening become possible. In monaural receiving or bilingual broadcasting receiving, no stereo identifying signal is generated, thereby turning off the switch 31, so that the surround signal is cut off. Accordingly, a generating circuit of a stereo pilot signal or a stereo identifying signal in the receiver, the input switching circuit 29 and the driving circuit 38** can be regarded as detection means for a monaural signal, so that generation of unnecessary signals in monaural signal receiving can be prevented.

As described above, according to the embodiments of the present invention, it is possible to generate a surround output signal in stereo signal receiving to perform a correct surround receiving, while in monaural receiving, to cut off a surround output signal path so as to prevent generation of unnecessary signals.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A surround-decoder comprising:

means for providing left and right stereo input signals, decoder means for receiving said left and right stereo input signals to generate left and right stereo output signals, a center output signal and a surround output signal, detectihg means for detecting said left and right stereo input signals to be monaural signals, and means responsive to said detecting means for cutting off said surround signal from said decoder means.

2. A surround-decoder according to claim 1, wherein, said detection means comprises:

subtracter means for subtracting said left and right stereo input signals, level detecting means for detecting level of an output signal of said subtracter means, said cutting off means being controlled by an output signal of said level detecting means.

3. A surround-decoder according to claim 2, wherein, said level detecting means comprises a time constant circuit, and drives said cutting off means to cut off when no output signal of said subtracter means is generated in a predetermined time period.

4. A surround-decoder according to claim 1, wherein, said left and right stereo input signals are FM stereophonic broadcasting signals comprising a stereo pilot signal of 19 KHz applied from an FM stereo receiver, and said detecting means detects said stereo pilot signal in said FM stereophonic broadcasting signals.

5. A surround-decoder according to claim 1, wherein said left and right stereo input signals are television multi-sound signals comprising a stereo identifying signal applied from a television multi-sound receiver, and said detection means detects said stereo identifying signal in said television multi-sound signals.

* * * * *